US007047925B2

(12) United States Patent
Hendriksma et al.

(10) Patent No.: US 7,047,925 B2
(45) Date of Patent: May 23, 2006

(54) DUAL FEED HYDRAULIC LASH ADJUSTER

(75) Inventors: Nick J. Hendriksma, Grand Rapids, MI (US); Timothy W. Kunz, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/792,418

(22) Filed: Mar. 3, 2004

(65) Prior Publication Data

US 2005/0193973 A1 Sep. 8, 2005

(51) Int. Cl.
*F01L 1/18* (2006.01)

(52) U.S. Cl. ..... 123/90.45; 123/90.39; 123/90.44; 123/90.46

(58) Field of Classification Search ..... 123/90.61, 123/90.62, 90.63, 90.39, 90.43, 90.45, 90.46, 123/90.52, 90.55; 403/114, 165
See application file for complete search history.

(56) References Cited

U.S. PATENT DOCUMENTS 2,681,644 A * 6/1954 Purchase, Jr. et al. ... 123/90.55
3,875,908 A * 4/1975 Ayres ..... 123/90.36
4,133,332 A * 1/1979 Benson et al. ..... 123/198 F
4,735,197 A * 4/1988 Ishida et al. ..... 123/90.58
6,006,710 A * 12/1999 Stephan ..... 123/90.43
6,325,034 B1 * 12/2001 Edelmayer ..... 123/90.43
6,619,252 B1 * 9/2003 Haas et al. ..... 123/90.52

FOREIGN PATENT DOCUMENTS

EP 0 908 605 A2 4/1999

* cited by examiner

*Primary Examiner*—Thomas Denion
*Assistant Examiner*—Ching Chang
(74) *Attorney, Agent, or Firm*—Patrick M. Griffin

(57) ABSTRACT

An improved dual feed hydraulic lash adjuster (HLA), for use in an internal combustion engine, comprising a hollow body and a plunger assembly disposed in a bore of the engine. A one-piece plunger body includes a first chamber for forming a low-pressure oil reservoir and receiving a lash adjustment mechanism, and a second chamber open at one end and partially closed hemispherically for supporting a rocker arm and providing valve deactivating oil thereto for an auxiliary valve actuation system. The first and second chambers are separated by a transverse web, optionally having a small-diameter passage therethrough for air evacuation. The one-piece plunger body provides a high degree of resistance to side loads which may be imposed on the HLA in use.

5 Claims, 3 Drawing Sheets

DUAL FEED HYDRAULIC LASH ADJUSTER

TECHNICAL FIELD

The present invention relates to hydraulic lash adjusters for combustion valves of internal combustion engines; more particularly, to a dual feed hydraulic lash adjuster for controlling the action of an auxiliary valve actuation system such as a variable lift valve mechanism; and most particularly, to an improved dual feed hydraulic lash adjuster having a one-piece plunger body for increased side-loading capability.

BACKGROUND OF THE INVENTION

Variable lift valve mechanisms for internal combustion engines are well known. In one example of such engines, a two-step roller finger follower rocker arm is known to pivot on a hydraulic lash adjuster (HLA) disposed on the engine block. An HLA generally comprises a slidable plunger that may be hydraulically extended to take up mechanical lash in a valve train. In an example where a valve lift change is accomplished by increasing oil pressure to the associated variable lift valve mechanism, the HLA is supplied with low pressure engine oil for conventional lubrication and lash adjustment. When a valve lift change is desired, oil pressure in the HLA is increased, and high-pressure oil flows through the same circuit in HLA to actuate the variable lift valve mechanism. To reverse the change the oil pressure is again reduced.

A problem exists in some prior art HLA assemblies having a single oil feed wherein the oil pressure is varied between the two modes. Because a minimum lash-adjusting oil pressure is present in the HLA at all times, the minimum required switching pressure must include the HLA minimum pressure. That is, the minimum required switching pressure must be higher than in other known systems wherein the lash adjuster and the switching element are independently supplied. Thus, providing dual independent oil supplies to a hydraulic lash adjuster represents an advance in the art.

Prior art HLAs receptive of such dual independent oil supplies comprise upper and lower plunger elements disposed within a body and defining a low pressure chamber or reservoir therebetween. The upper portion is dedicated to the auxiliary valve actuation function, and the lower portion to the hydraulic lash adjustment function. Because each of the elements is axially relatively short, the overall plunger may exhibit inferior side-load capability, resulting in relatively short working lifetimes and premature wear of such HLAs.

It is a principal object of the present invention to provide a dual feed hydraulic lash adjuster having superior side-load capability.

SUMMARY OF THE INVENTION

Briefly described, a dual feed hydraulic lash adjuster in accordance with the invention comprises a plunger assembly disposed within an engine bore. A one-piece plunger body includes a first chamber for forming a low-pressure oil reservoir and receiving a lash adjustment mechanism, and a second chamber open at one end and partially closed hemispherically for supporting a rocker arm and providing valve oil thereto for an auxiliary valve actuation system. The first and second chambers are separated by a transverse web, optionally having a small-diameter passage therethrough for purging of air from the lash adjustment mechanism. The plunger body is provided with a first annular collector groove and entrance port for supplying lash-adjusting oil to the first chamber, and a second annular collector groove and entrance port for supplying oil for the auxiliary valve actuation system to the second chamber. The one-piece plunger body is substantially longer than the upper section of a prior art two-piece plunger body and therefore provides a much higher resistance to torsional side loads which may be imposed on the HLA in use.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
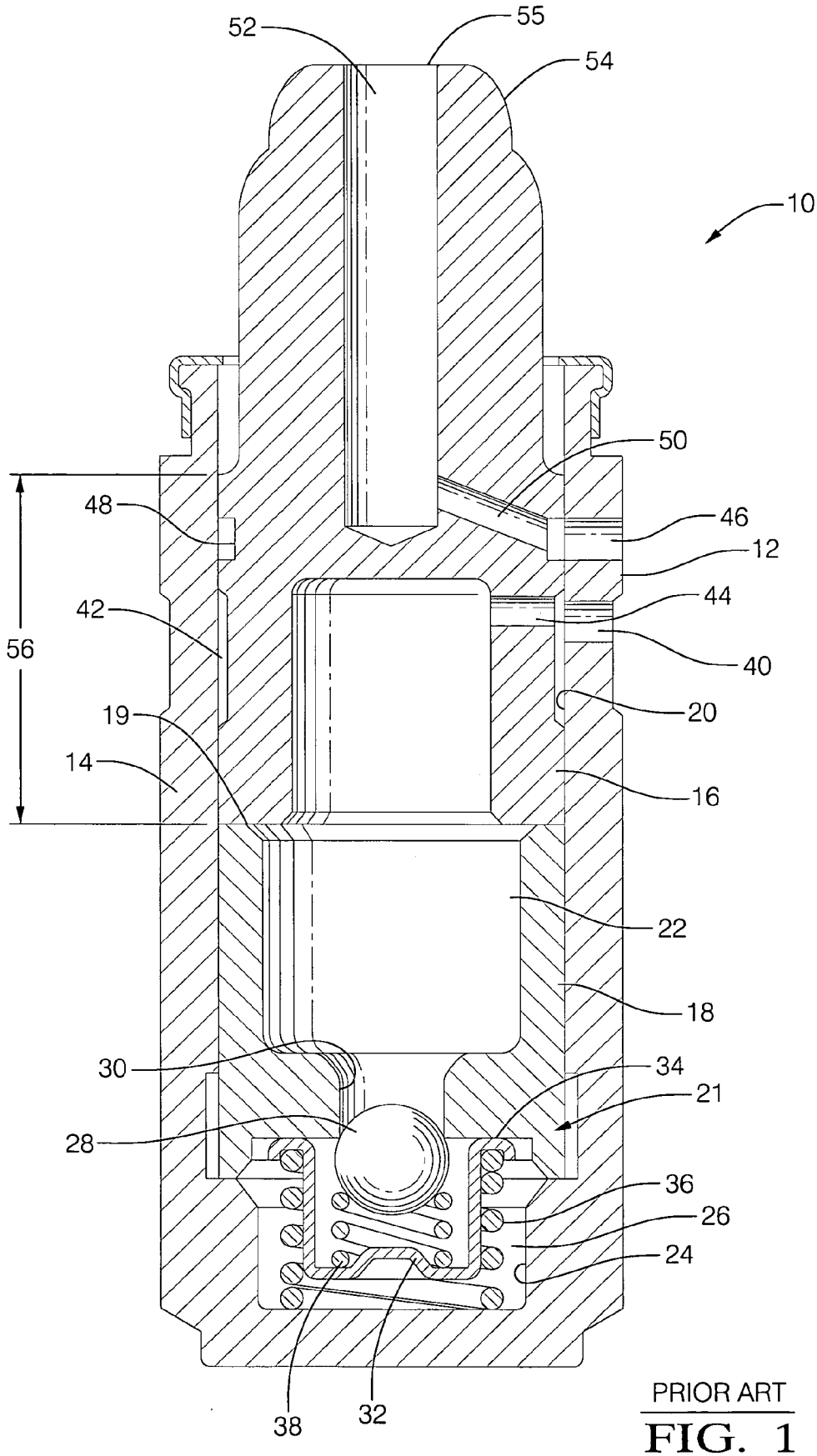
PRIOR ART FIG. 1
FIG. 1 is an elevational cross-sectional view of a prior art two-step hydraulic lash adjuster, showing the plunger assembly comprising upper and lower plunger body portions.

Referring to FIG. 1, a prior art dual feed hydraulic lash adjuster 10 includes a lash adjuster body 12 and a plunger assembly, generally designated as 14, which is slidingly disposed within body 12. Plunger assembly 14 includes an upper plunger element 16 and a lower plunger element 18 meeting at an interface 19, and further includes a hydraulic element assembly 21 (HEA). The plunger elements are received within body 12 in a close-fitting relationship within a bore 20 of body 12. As elements of HEA 21, upper and lower plunger elements 16,18 define a low pressure chamber 22 (reservoir) therebetween. The bottom of lower plunger element 18 forms, in cooperation with the end of a reduced diameter portion 24 of body bore 20, a high pressure chamber 26. A check valve 28 is disposed in the end of a passage 30 which connects high pressure chamber 26 and low pressure chamber 22. Check valve 28 is retained in a cage 32 which is in an interference fit within a counterbore 34 formed in lower plunger element 18. Cage 32 provides a seat for a lash adjuster plunger spring 36. A bias spring 38 biases check valve 28 into a normally closed position. A first oil entry port 40 in body 12 opens into bore 20 and intersects a first annular collector groove 42 which, in turn, intersects a first radial port 44 in upper plunger element 16 to supply hydraulic fluid from a first source (not shown) to low pressure chamber 22. A second oil entry port 46 opens into bore 20 of body 12 and intersects a second collector groove 48 which, in turn, intersects a second radial port 50 in upper plunger element 16 to provide hydraulic fluid from a second source (not shown) to an axial passage 52 for an auxiliary valve actuation system (not shown). Typically, the surface of the rocker arm engages a hemispherical element 54 formed on the upper end of plunger assembly 14, hydraulic fluid being passable through central opening 55.

Because plunger assembly 14 is formed in two parts as upper and lower plunger elements 16,18 meeting at interface 19, the engagement length 56 of upper element 18 within bore 20 is relatively short, making prior art HLA 10 relatively vulnerable to displacement or distortion by side-load forces on upper element 16 during use. Such forces may cause lash adjuster body 12 to fail structurally, allowing escape of hydraulic fluid past upper element 16 and causing failure of the HLA.

Figure 2:
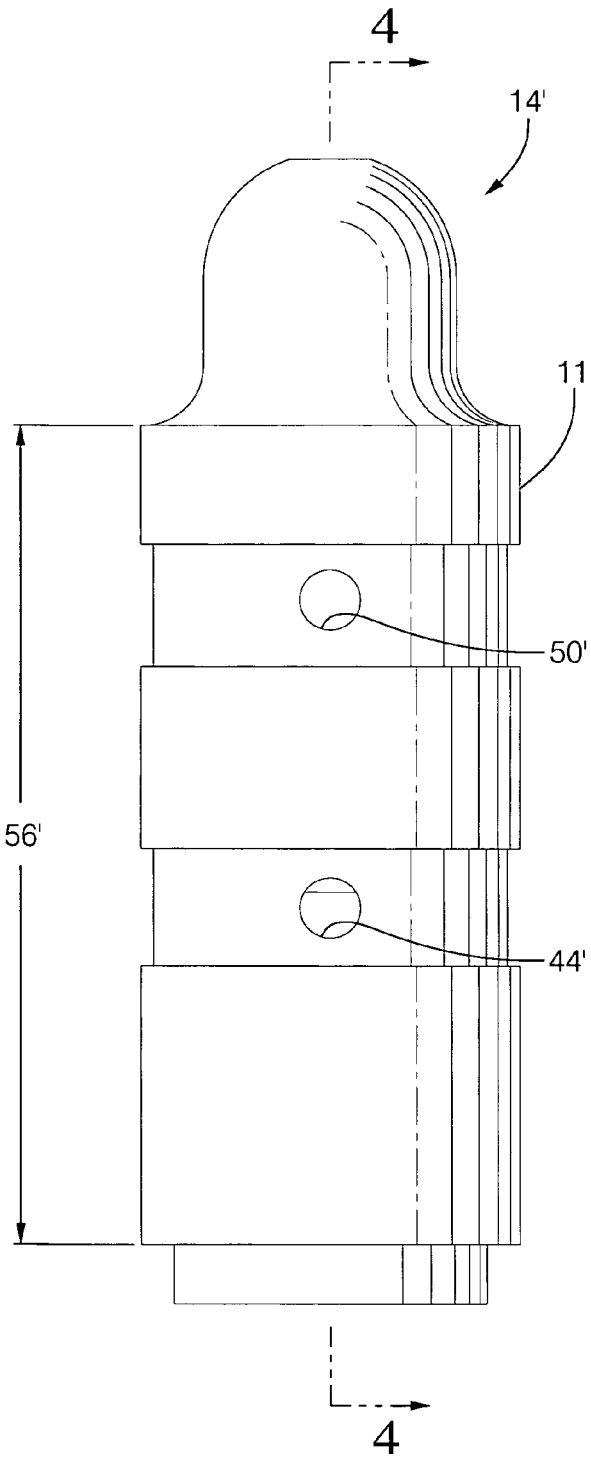
FIG. 2 is an elevational view of an improved plunger in accordance with the invention for a two-step hydraulic lash adjuster.
Figure 3:
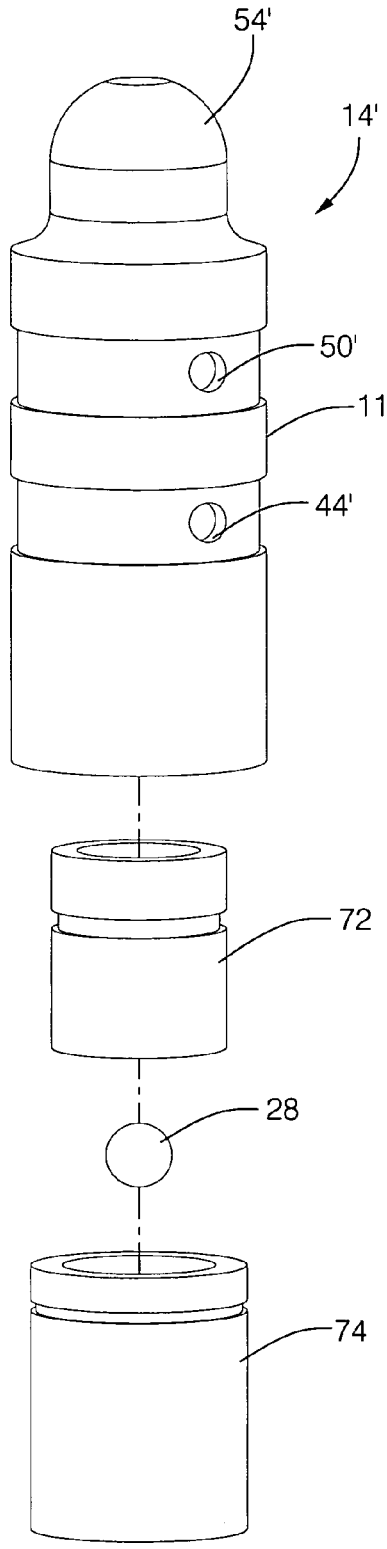
FIG. 3 is an exploded isometric view of the improved plunger shown in FIG. 2.
Figure 4:
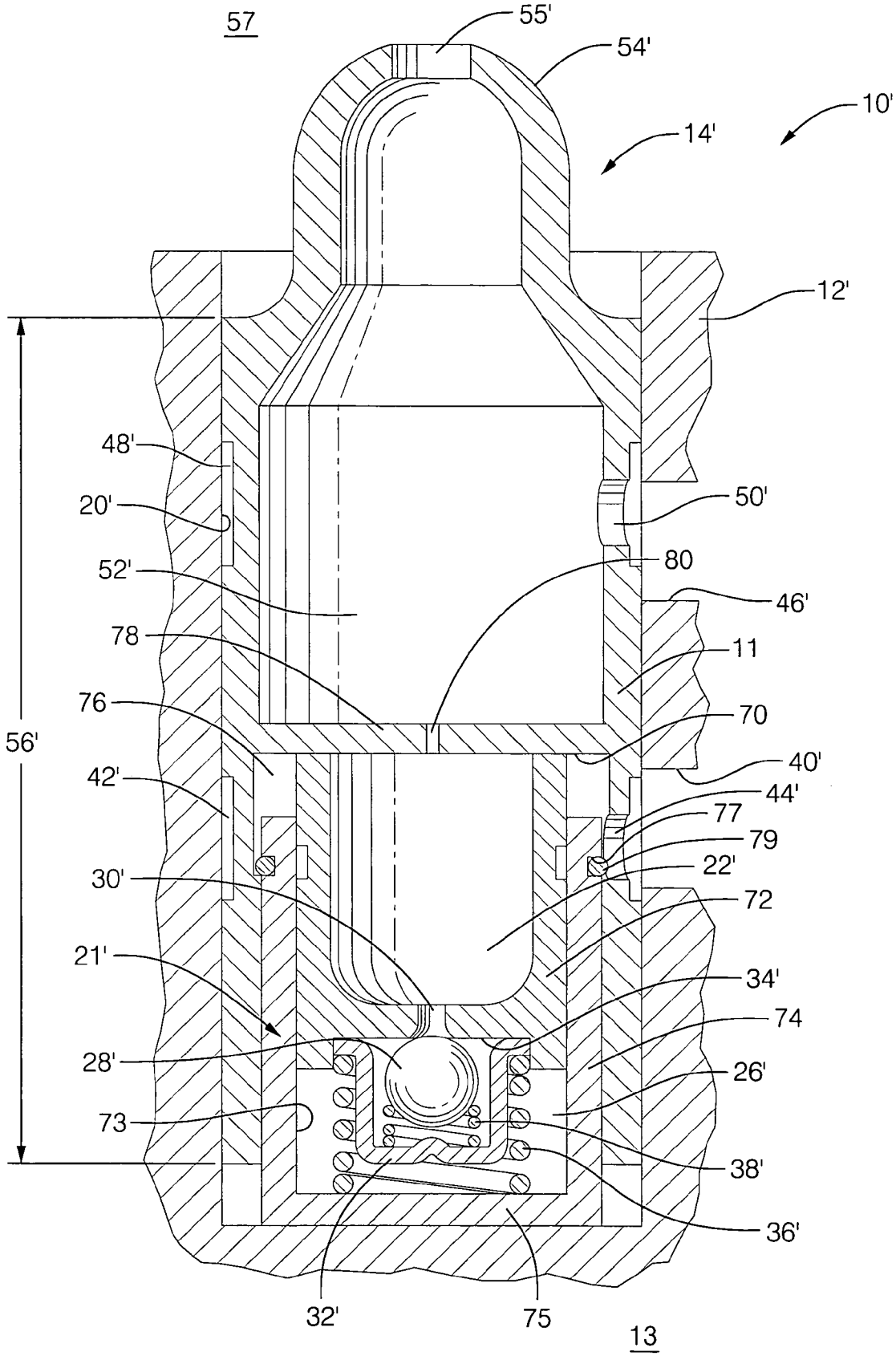
FIG. 4 is an elevational cross-sectional view of the improved plunger shown in FIG. 2, taken along line 4—4 therein, installed for use in a two-step hydraulic lash adjuster in accordance with the invention.

Referring to FIGS. 2 through 4, where like numbers (primed) are used for like elements in prior art HLA 10, an improved plunger assembly 14' for an improved dual feed hydraulic lash adjuster 10' is shown. In assembly 14', lash adjuster body 12 of the prior art is eliminated. Instead, assembly 14' is inserted directly into close-fitting bore 20' formed in casting 12' of an internal combustion engine 13. One-piece plunger body 11 extends virtually the full length of bore 20' and, because of its one-piece design, provides a greatly increased engagement length 56', a significant benefit of an improved plunger assembly, and, when installed in bore 20', forming an improved HLA 10', in accordance with the invention.

All elements of a dual feed HLA plunger assembly 14' are contained within one-piece plunger body 11. A modified HEA 21' resides in an appropriately-sized counterbored chamber 70 formed in one end of plunger body 11'. HEA 21' includes a cylindrical first element 74 having well 73 and closed bottom 75, and a low-pressure reservoir 22' contained in a cylindrical second element 72 slidably disposed in and cooperating with first element 74 to form a high-pressure chamber 26'. A check valve 28' is disposed in the end of a passage 30' which connects high pressure chamber 26' and low pressure chamber 22'. Check valve 28' is retained in a cage 32' which is in an interference fit within a counterbore 34' formed in second element 72. Cage 32' provides a seat for a lash adjuster plunger spring 36'. A bias spring 38' biases check valve 28' into a normally closed position. However, it should be understood that various other check ball biasing arrangements are known, and the present invention is not limited to any particular check valve configuration or arrangement for biasing the check valve. Furthermore, the check valve may be positioned to be "free" and not be biased in any direction.

The entry to low-pressure chamber 22' is covered by a fixed web 78. Preferably, a small-diameter passage 80 is provided through web 78 to permit air to bleed out of the HEA.

A first entry port 40' in casting 12' opens into bore 20' and intersects a first annular collector groove 42' which, in turn, intersects a first radial port 44' in plunger body 11' to supply hydraulic fluid from a first source (not shown) to an annular reservoir 76 and thence to low pressure chamber 22'. Thus the lash-adjusting mechanism is supplied from a first hydraulic fluid source, for example an engine oil pump, and functions conventionally to eliminate lash in the valve train.

A second entry port 46' in casting 12' opens into bore 20' and intersects a second collector groove 48' which, in turn, intersects a second radial port 50' in plunger body 11' to provide hydraulic fluid from a second source (not shown) to axial second chamber 52' for engaging an associated auxiliary valve actuation system such as, for example, a variable valve deactivation rocker arm assembly (not shown). The surface of the rocker arm engages a hemispherical element 54' formed on the upper end of plunger assembly 14', hydraulic fluid being passable through central opening 55'. Thus the axial chamber 52' is supplied from a second hydraulic fluid source, for example, a controlled split of flow from an engine oil pump, and functions conventionally to activate or deactivate the auxiliary valve actuation system.

First element 74 is provided with an annular groove 77 which is positioned axially to overlap annular reservoir 76 after assembly of plunger assembly 14'. A compressible expansion ring 79 in groove 77 snaps into reservoir 76, locking HEA 21' into plunger body 11.

In operation, hydraulic fluid for lash adjustment is provided from a first source at a first pressure to low-pressure chamber 22' via port 40', annular collector groove 42', and reservoir 70. Preferably, this fluid pressure is continuously available during operation of the associated engine. Lash adjustment spring 36' urges second element 72 away from bottom 75 and thereby urges plunger body 11 axially of lifter body 12' until mechanical lash is removed from the valve train. The pressure of hydraulic fluid in chamber 22' overcomes bias spring 38' and fills high-pressure chamber 26', conventionally making lash adjuster 10' hydraulically rigid. When the engine control module signals the need to engage the auxiliary valve actuation system, hydraulic fluid is provided from a second source, which may be at a higher pressure than fluid from the first source, through port 46', annular collector groove 48', port 50', chamber 52', and opening 55' to the auxiliary valve actuation system. When engagement of the auxiliary valve actuation system is no longer required, the second source is shut off from HLA 10', and pressure is relieved via leakage at mechanical joints in the valve train, such as at surface 54', and hydraulic fluid drains to a sump (not shown).

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A plunger assembly for use in a hydraulic lash adjuster for eliminating lash in a valve train of an internal combustion engine and for controllably providing hydraulic fluid to an associated auxiliary valve actuation system, comprising:

a) a one-piece plunger body including a first chamber for forming a low-pressure oil reservoir and receiving a lash adjustment mechanism and a second chamber for providing hydraulic fluid to said auxiliary valve actuation system;

b) a first port for passage of hydraulic fluid from a first source into said first chamber; and c) a second port for passage of hydraulic fluid from a second source into said second chamber, wherein said first and second chambers are separated by a transverse web, and wherein a passage is provided through said web between said first and second chambers.

2. A plunger assembly in accordance with claim 1 wherein said lash adjustment mechanism comprises:

a) a first element having a well and well bottom therein, and being slidably disposed in said first chamber;

b) a second element containing said low-pressure oil reservoir and being slidably disposed in said first element well and off-spaced from said bottom to define a high-pressure chamber, said low-pressure reservoir and said high-pressure chamber being connected by a passage;

c) a check valve disposed in said high-pressure chamber for regulating flow of oil through said passage; and d) a lash adjustment spring disposed in said high-pressure chamber for extending said plunger assembly to remove lash from said valve train.

3. A two-step hydraulic lash adjuster for eliminating lash in a valve train of an internal combustion engine and for controllably providing hydraulic fluid to an associated auxiliary valve actuation system, comprising:

a plunger assembly disposed in a bore of said engine and including a one-piece plunger body having a first chamber for forming a low-pressure oil reservoir and receiving a lash adjustment mechanism and a second chamber for providing hydraulic fluid to said auxiliary valve actuation system, a first port for passage of hydraulic fluid from a first source into said first chamber, and a second port for passage of hydraulic fluid from a second source into said second chamber, wherein said first and second chambers are separated by a transverse web, and wherein a passage is provided through said web between said first and second chambers.

4. An internal combustion engine including an auxiliary valve actuation system for deactivating a valve train in the engine, the engine comprising:

an axial bore;

a dual feed hydraulic lash adjuster disposed in said axial bore for eliminating lash in said valve train and for providing hydraulic fluid to said auxiliary valve actuation system, said lash adjuster including a plunger assembly including a one-piece plunger body having a first chamber for forming a low-pressure oil reservoir and receiving a lash adjustment mechanism and a second chamber for providing hydraulic fluid to said auxillary valve actuation system, a first port for passage of hydraulic fluid from a first source into said first chamber, and a second port for passage of hydraulic fluid from a second source into said second chamber, wherein said first and second chambers are separated by a transverse web, and wherein a passage is provided through said web between said first and second chambers.

5. An engine in accordance with claim 4 wherein said dual feed hydraulic lash adjuster is in contact with said axial bore.

* * * * *